United States Patent [19]

Rivera

[11] 4,227,270

[45] Oct. 14, 1980

[54] COMBINED BABY PILLOW CASE AND BOTTLE HOLDER

[76] Inventor: Rafael R. Rivera, 32-47 68th St., Flushing, N.Y. 11377

[21] Appl. No.: 33,750

[22] Filed: Apr. 26, 1979

[51] Int. Cl.[2] ..... A45C 9/00

[52] U.S. Cl. ..... 5/436; 5/417; 5/434–490; 248/102

[58] Field of Search ..... 5/417, 420, 434, 442, 5/490–492, 497; 248/102, 106; 190/2; 150/1, 28 R, 35

[56] References Cited

U.S. PATENT DOCUMENTS

| | | | |
|---|---|---|---|
| 814,574 | 3/1906 | Timberlake | 248/102 |
| 2,651,485 | 9/1953 | Schutz | 248/102 |
| 4,064,576 | 12/1977 | Threat | 5/497 |
| 4,154,323 | 5/1979 | Sneider | 5/417 |

*Primary Examiner*—Casmir A. Nunberg
*Attorney, Agent, or Firm*—Richard L. Miller

[57] ABSTRACT

A pillow case having a receptacle upon its upper side in which a baby bottle is retained during a time of nursing, and the pillow case upper side including a sideward extending flap upon which a baby rests its head while sucking on the bottle nipple.

3 Claims, 4 Drawing Figures

COMBINED BABY PILLOW CASE AND BOTTLE HOLDER

BACKGROUND OF THE INVENTION

The invention relates generally to infant accessories. More specifically, it relates to baby bottle holders. Heretofore numerous baby bottle holders have been developed in order to eliminate need of a person to hold the bottle for the infant while nursing therefrom. None of these holders have proven to be ideal. Some holders themselves may be possibly shifted in position relative to an infant if the infant moves so that it cannot relocate the nipple again. Some are cumbersome. Others are of a hard material and are not as safe near an infant. Others are difficult to clean. Therefore, new designs of bottle holders have continued to be developed over the years, in search of a better one.

SUMMARY OF THE INVENTION

Therefore it is a principal object of the present invention to provide a baby bottle holder which is combined with a pillow case for a pillow positioned alongside an infant's head and upon which the baby bottle is stationarily retained; the holder accordingly being of a soft, safe material that can be easily laundered, and which can be folded away in minimum space during travel.

Another object is to provide a combined baby pillow case and bottle holder that includes an extending flap onwhich an infant rests its head while nursing, so as to catch and dribbling from the infant's mouth.

Still a further object is to provide a combined baby pillow case and bottle holder which is inexpensive to manufacture, as it is made entirely on a sewing machine and does not require any expensive tooling up of production dies or the like.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specifif construction illustrated and described within the scope of the appended claims.

BRIEF DESCRIPTION OF THE DRAWING FIGURES

DETAILED DESCRIPTION OF PREFERRED EMBODIMENT

Figure 1:
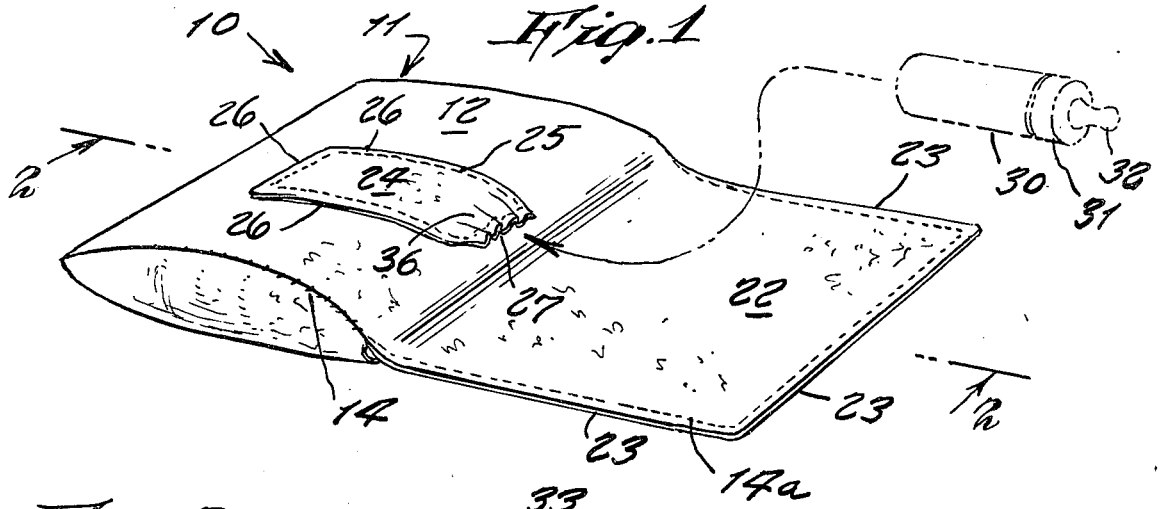
FIG. 1 is a top perspective view of the invention.

Referring now to the drawing in greater detail, the reference numeral 10 represents a combined baby pillow case and bottle holder, according to the present invention, wherein there is a pillow case member 11 comprised of a top panel 12 and bottom panel 13 made of rectangular shaped fabric material and which are stitched together by thread 14 along two mating straight side edges 16 and 17 thereof after folding along edge 15 while a fourth straight side edge 18 (of the panel 13) is left unstitched in order to form an entry 19 to a pocket 20 thus made between the panels, and into which a pillow 21 is removably placed.

As clearly shown in the drawing, the top panel 12 includes a sidewardly extending flap 22 formed by a continuation of the panel material, the flap being approximately the same size and shape, in length and width, as the bottom panel. The three straight side edges 23 of the flap are hemmed over by the thread **14*a***, as shown.

Figure 2:
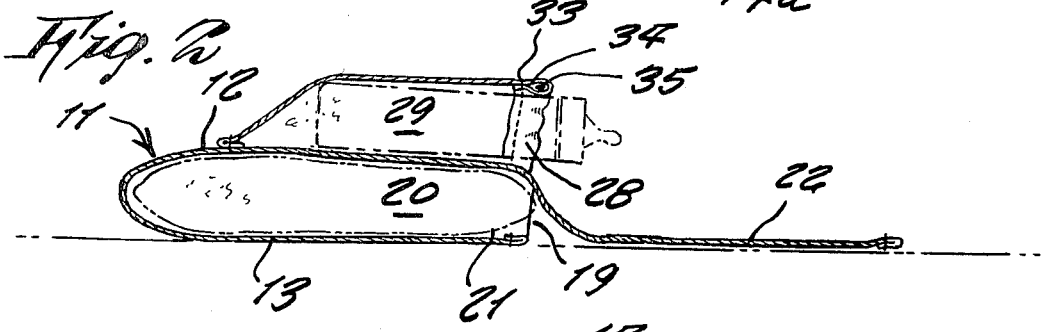
FIG. 2 is a cross sectional view on line 2—2 of FIG. 1, showing a pillow and a baby bottle inserted into the device.
Figure 3:
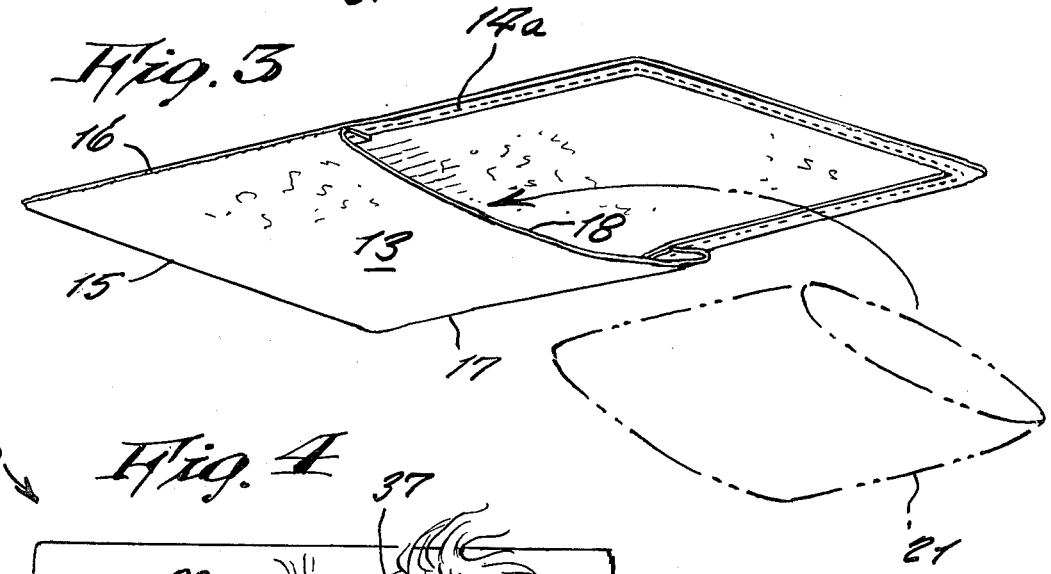
FIG. 3 is a bottom perspective view thereof.
Figure 4:
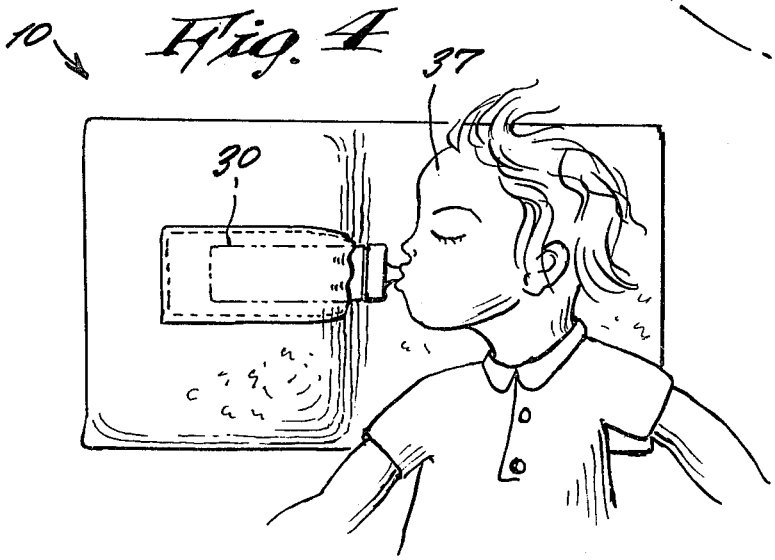
FIG. 4 is a top view showing the invention in use.

Upon an outer, upper side of the top panel, a small, rectangular shaped panel 24 of a similar fabric as panels 12 and 13, is attached by thread 25 stitched along three straight side edges 26 of the panel 24, while a fouth edge 27 thereof is left unattached in order to form an entry 28 to a pocket 29 thus formed, and into which a baby bottle 30 can be readily inserted. The panel 24 and its resultant pocket are of appropriate size acccordingly so as to fit the bottle with only the bottle cap 31 and nipple 32 protruding outwardly therefrom when the bottle is tucked fully in. It is to be noted that the edge 27 aligns with the edge 18 and the pocket entries 19 and 28 also vertically align, as shown in FIG. 2. The fourth edge 27 is rolled over and secured by a thread 33 so as to form a pocket 34 in which an elastic tape 35 is secured in taut position in order to form pleats 36 and snuggly grasp the bottle, preventing it from accidently falling out of the pocket.

The fabric materials used, is preferably a cotton terry cloth such as is used in toweling.

In use of the invention, the pillow 21 is inserted into the pocket. When traveling lightly, and not wishing to carry excessive baggage, a folded-over sweater, or other fabric garment can be used instead of the pillow. The bottle is then inserted into the pocket 29. The infant lays with its head 37 upon the flap positioned so as to suck on the nipple 32. The pillow or other stuffing in the pocket 20 thus has raised the reclining bottle to an elevation so as to align the nipple with the infant's mouth, when the head is resting on its side. By turning the invention one-half way around, the infant can rest on its other side. Perferably the pillow is sufficiently thick so that the reclining bottle tilts downwardly toward the nipple in order that nearly all the liquid will drain out, thus preventing the infant from sucking in air.

While certain novel features of this invention have been shown and described and are pointed out in the annexed claims, it will be understood that various omissions, substitutions and changes in the forms and details of the device illustrated and in its operation can be made of those skilled in the art without departing from the spirit of the invention.

What is claimed is:

1. A combined baby pillow case and bottle holder assembly, comprising in combination a pillow case member, comprised of a rectangular upper and lower fabric panels secured together along three side edges thereof, a pocket between said panels accessible from an opening along a fourth side edge of said pillow case, said fourth side edge forming said opening having a flap extending from an upper one of said panels, a pillow inserted through said opening into said pocket, and said upper panel having said flap extending therefrom also having a small retangular, fabric panel stitched upon an upper side thereof, said small rectangular fabric panel being stitched along three side edges thereof to said upper panel to form a pocket therebetween, a fourth side edge of said small panel being unstitched to said upper panel, and forming an opening for said pocket for insertion of a baby bottle therein.

2. The combination as set forth in claim 1, wherein an opening edge of said pillow pocket aligns with an opening edge of said baby bottle pocket.

3. The combination as set forth in claim 2, wherein said flap comprises a rectangular extension of said upper panel.

* * * * *